US009035838B2

(12) United States Patent
Le Bars et al.

(10) Patent No.: US 9,035,838 B2
(45) Date of Patent: May 19, 2015

(54) CONCENTRIC MILLIMETER-WAVES BEAM FORMING ANTENNA SYSTEM IMPLEMENTATION

(75) Inventors: Philippe Le Bars, Thorigné Fouillard (FR); Hervè Merlet, Servon sur Vilaine (FR); Mohammed Himdi, Rennes (FR); Olivier Lafond, Gosné (FR)

(73) Assignee: Canon Kabushiki Kaisha, Tokyo (JP)

( * ) Notice: Subject to any disclaimer, the term of this patent is extended or adjusted under 35 U.S.C. 154(b) by 126 days.

(21) Appl. No.: 13/526,318

(22) Filed: Jun. 18, 2012

(65) Prior Publication Data

US 2013/0082889 A1 Apr. 4, 2013

(30) Foreign Application Priority Data

Jun. 20, 2011 (GB) ..... 1110356.1

(51) Int. Cl.
*H01Q 19/06* (2006.01)
*H01Q 15/04* (2006.01)
*H01Q 3/46* (2006.01)

(52) U.S. Cl.
CPC ..... *H01Q 19/06* (2013.01); *H01Q 15/04* (2013.01); *H01Q 19/065* (2013.01); *H01Q 3/46* (2013.01)

(58) Field of Classification Search
CPC ..... H01Q 15/04; H01Q 19/06; H01Q 19/65; H01Q 3/46
USPC ..... 343/753, 754, 909, 911 R, 911 L
See application file for complete search history.

(56) References Cited

U.S. PATENT DOCUMENTS 2,870,444 A * 1/1959 Broussaud ..... 343/909
3,392,394 A * 7/1968 Caballero, Jr. ..... 343/754

(Continued)

FOREIGN PATENT DOCUMENTS

EP 1253668 A1 10/2002
GB 1166105 A 10/1969

(Continued)

OTHER PUBLICATIONS

Behzad Razavi, "Design of Millimeter-Wave CMOS Radios: A Tutorial", IEEE Transactions on Circuits and Systems—Regular Papers, Jan. 1, 2009, p. 4-16, vol. 56, No. 1, IEEE, Piscataway, NJ.

(Continued)

*Primary Examiner* — Tho G Phan
(74) *Attorney, Agent, or Firm* — Canon USA Inc IP Division

(57) ABSTRACT

An antenna implementation comprises an electromagnetic lens and at least one electromagnetically shielding member. The electromagnetic lens is adapted to guide at least one electromagnetic signal by means of at least a variation in permittivity. The at least one electromagnetically shielding member encapsulates the electromagnetic lens partially so as to direct at least one electromagnetic signal propagating through the electromagnetic lens. The at least one electromagnetically shielding member can advantageously be part of an enclosure; said enclosure encapsulates partially the electromagnetic lens. The antenna can further comprise antenna transmission means that contain wave guides. Said waveguides can advantageously be incorporated into the enclosure. The antenna is particularly suited for implementations using Substrate Integrated Waveguide techniques. SIW techniques allow miniaturization of the antenna and offer the advantage of low energy consumption as may be required in portable devices.

18 Claims, 13 Drawing Sheets

(56) References Cited

U.S. PATENT DOCUMENTS

| | | | | |
|---|---|---|---|---|
| 5,142,290 | A | 8/1992 | DuFort | |
| 6,081,239 | A * | 6/2000 | Sabet et al. | 343/753 |
| 6,421,021 | B1 | 7/2002 | Rupp et al. | |
| 6,563,477 | B2 * | 5/2003 | Ishikawa et al. | 343/911 R |
| 6,606,077 | B2 * | 8/2003 | Ebling et al. | 343/911 L |
| 2002/0174685 | A1 | 11/2002 | Nonogaki | |
| 2003/0164926 | A1 * | 9/2003 | Nakano et al. | 353/31 |
| 2007/0195004 | A1 | 8/2007 | Rebeiz et al. | |
| 2008/0048921 | A1 | 2/2008 | Rebeiz et al. | |
| 2010/0134368 | A1 | 6/2010 | Lafond et al. | |
| 2010/0202061 | A1 | 8/2010 | Black, Jr. et al. | |

FOREIGN PATENT DOCUMENTS

| | | | |
|---|---|---|---|
| WO | 01/28162 | A1 | 4/2001 |
| WO | 01/37374 | A1 | 5/2001 |
| WO | 2007/003653 | A1 | 1/2007 |
| WO | 2009/013248 | A1 | 1/2009 |

OTHER PUBLICATIONS

Sebastien Rondineau, Mohamed Himdi, and Jacques Sorieux, A sliced spherical Luneburg lens, IEEE Antennas and Wireless Propagation Letters, 2003, p. 163-166, vol. 2, Issue 1, IEEE, Piscataway, NJ.

SB9220/SB9210 WirelessHD HRTX Chipset, "Complete Wireless Video-Area Network Solution", May 30, 2011, Silicon Image, Sunnyvale, CA.

Z Doahong et al. MM-Wave Cylindrical Dielectric Lens Antenna for Full Azimuth Scanning Coverage, 2011 China-Japan Joint Microwave Conference Proceedings (CJMW), May 27, 2011, pp. 1-4, IEEE, Piscataway, NJ.

T. Komljenovic et al., Layered Circular-Cylindrical Dielectric Lens Antennas—Synthesis and Height Reduction Technique, IEEE Transactions on Antennas and Propagation, May 2010, pp. 1783-1788, vol. 28, Issue 5, IEEE, Piscataway, NJ.

R. K. Luneburg, Mathematical Theory of Optics, Second Printing, pp. v-xxx, 1, 128-215, University of California Press, Berkeley, CA, 1966.

Liang Xue, Vincent Fusco, Patch-fed planar dielectric slab waveguide Luneburg lens, IET Microwaves, Antennas & Propagation, Mar. 3, 2008, 2(2):109-114, The Institution of Engineering and Technology, Stevenage, UK, 2008.

Xidong Wu, Jean-Jacques Laurin, Fan-Beam Millimeter-Wave Antenna Design Based on the Cylindrical Luneberg Lens, IEEE Transactions on Anetennas and Propogation, Aug. 1, 2007, 55(8):2147-2156, IEEE, Piscataway, NJ, 2007.

Liang Xue, Vincent Fusco, 24 GHz Automotive radar planar Luneburg lens, IET Microwaves, Antennas & Propagation, Jun. 2007, 1(3):624-628, The Institution of Engineering and Technology, Stevenage, UK, 2007.

Kenichi Sato, Hiroshi Ujiie, A Plate Luneberg Lens with the Permittivity Distribution Controlled by Hole Density, Electronics and Communications in Japan, Part 1, Sep. 2002, 85(9):1-12, John Wiley & Sons Inc, Malden MA, 2002.

* cited by examiner

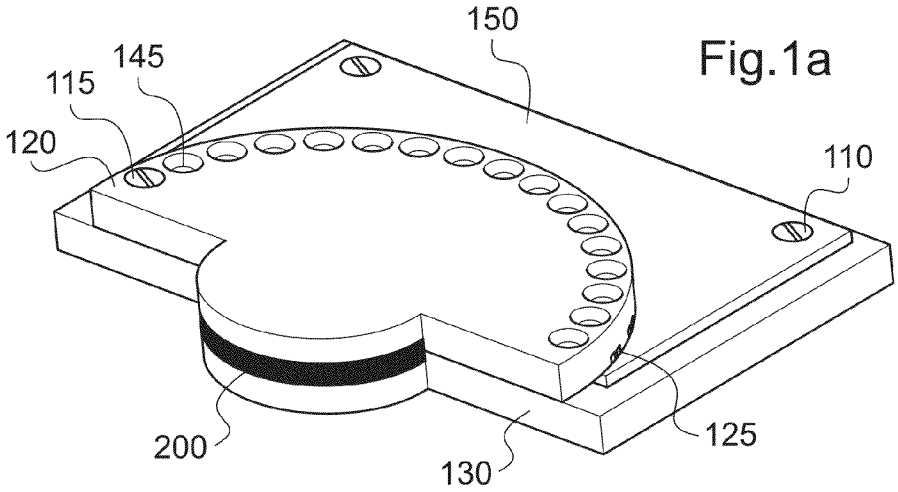
Fig.1a
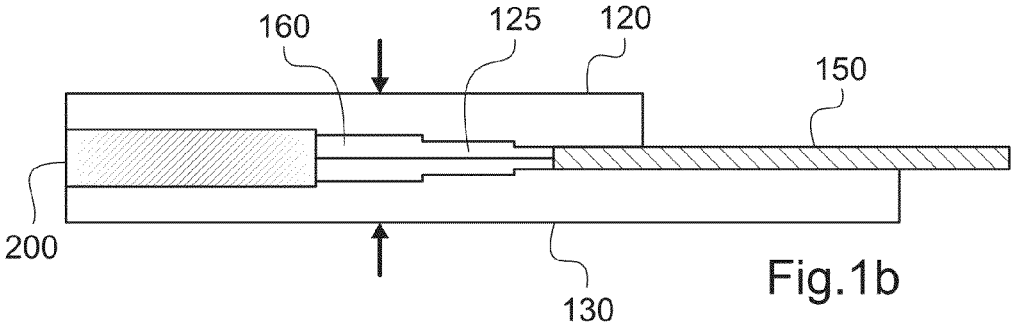
Fig.1b
Fig.2
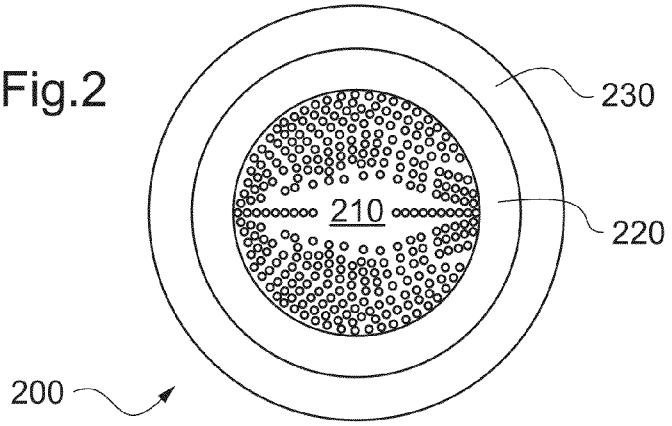

Fig.8
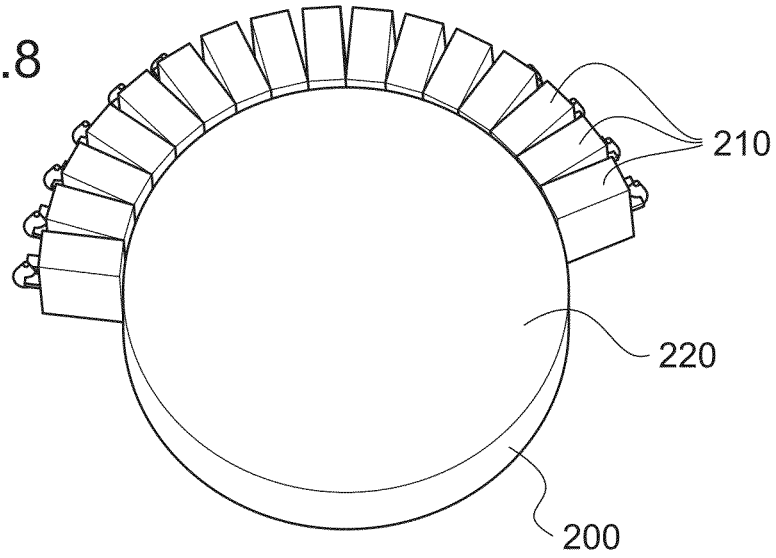
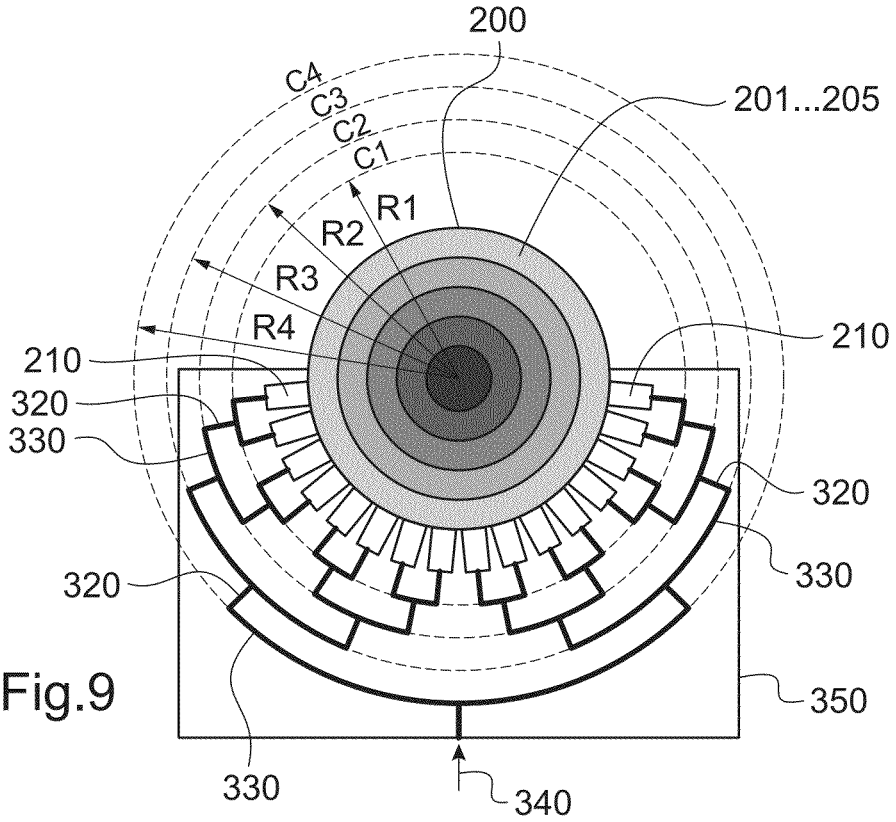
Fig.9

Fig.11a
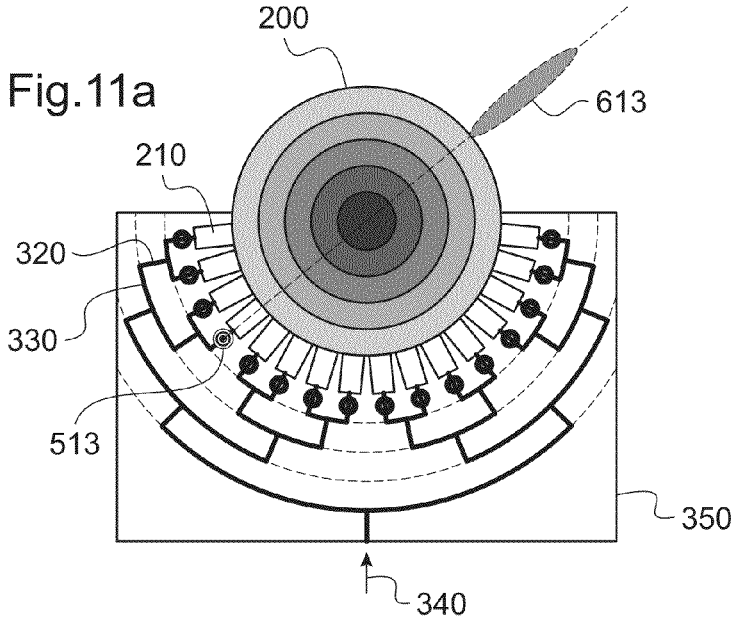
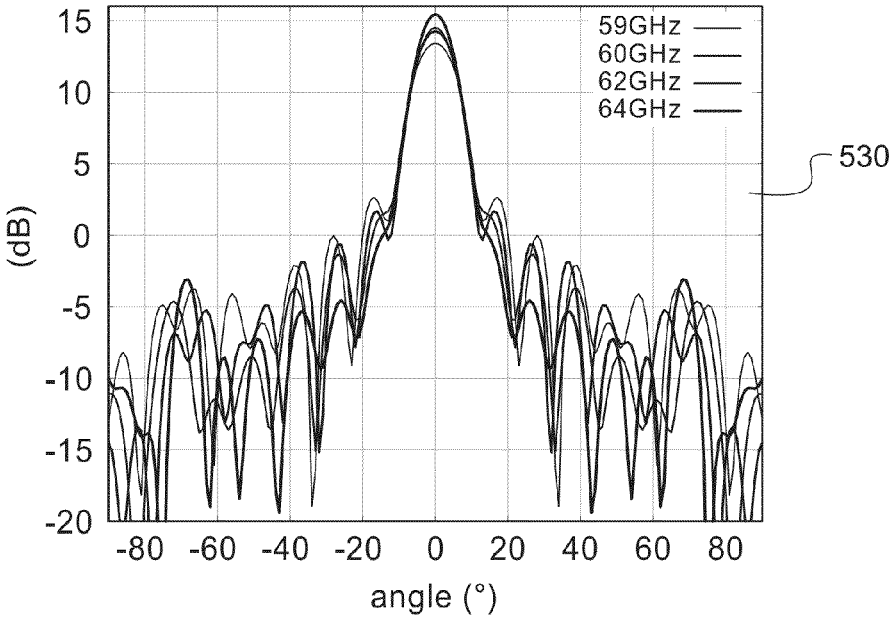
Fig.11b

Fig.12a
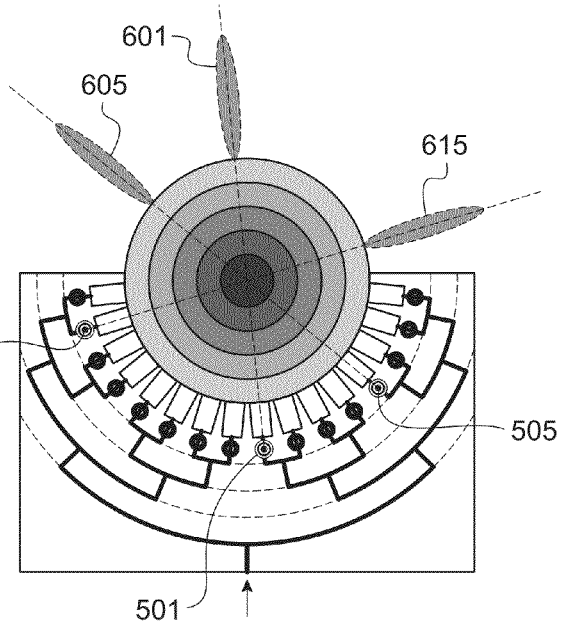
Fig.12b
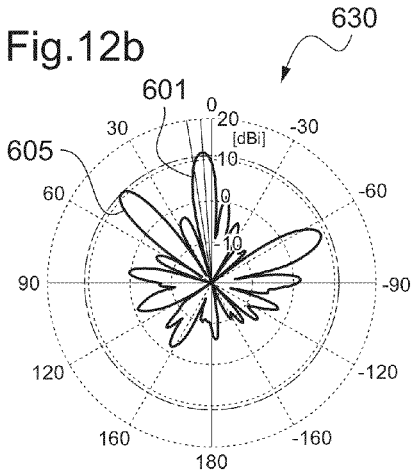
Frequency = 60
Main lobe magnitude = 12.1 dBi
Main lobe direction = 4.0 deg.
Angular width [3 dB] = 8.9 deg.
Side lobe level = -1.1 dB
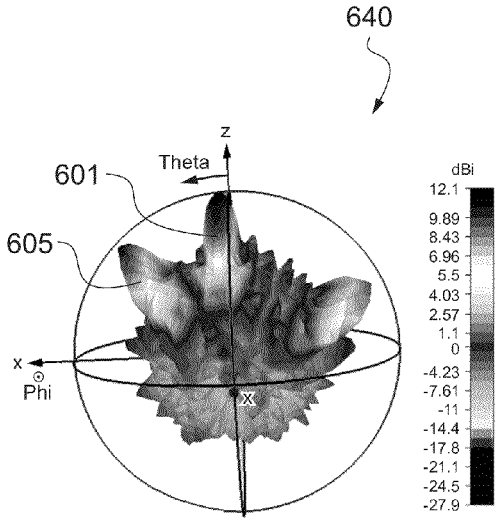
Frequency = 60
Rad. effic. = -0.02583 dB
Tot. effic. = -0.8045 dB
Dir. = 12.09 dBi
Fig.12c Fig.13a
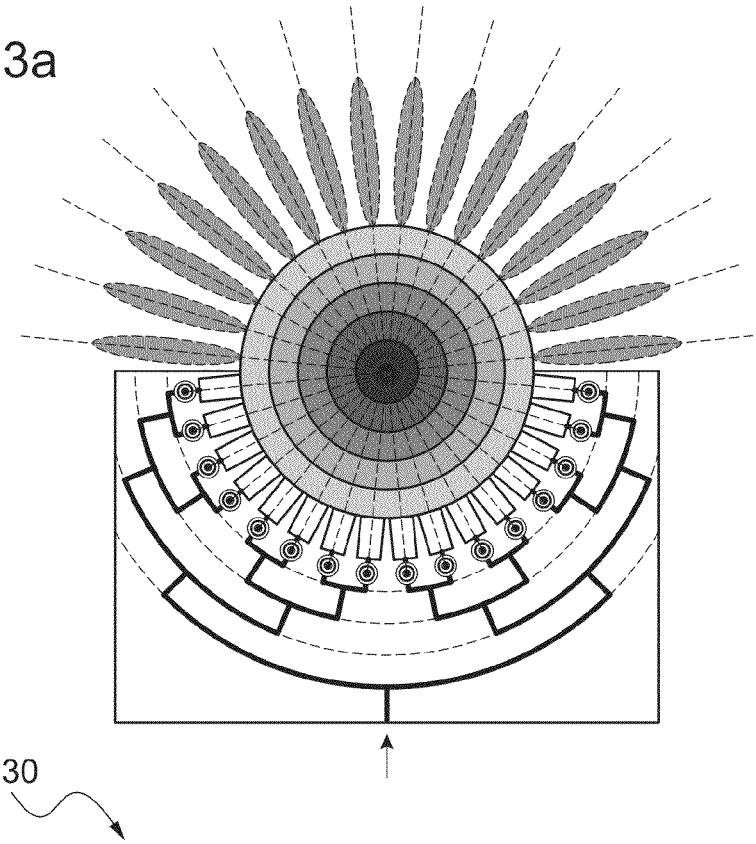
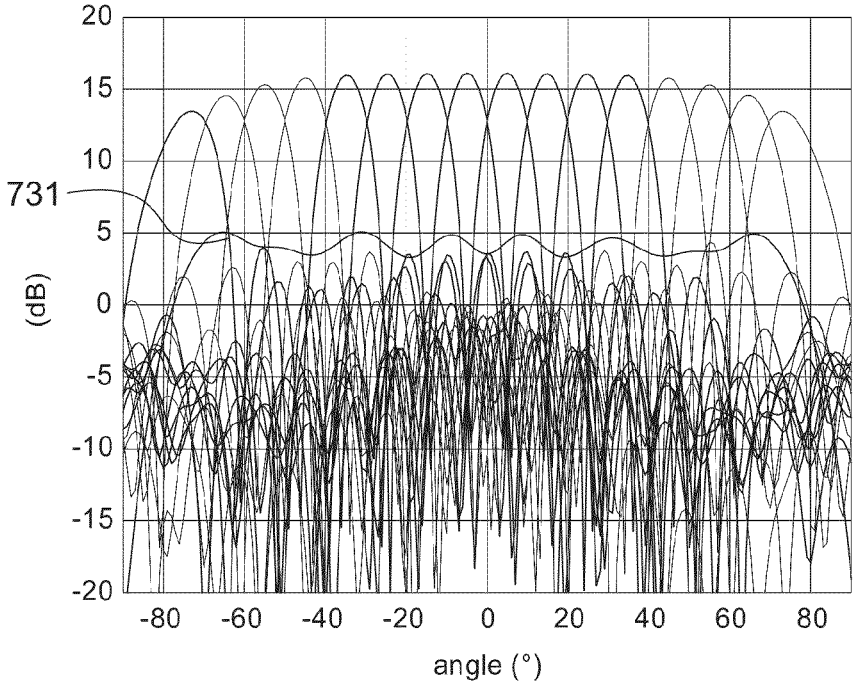
Fig.13b Fig.14a
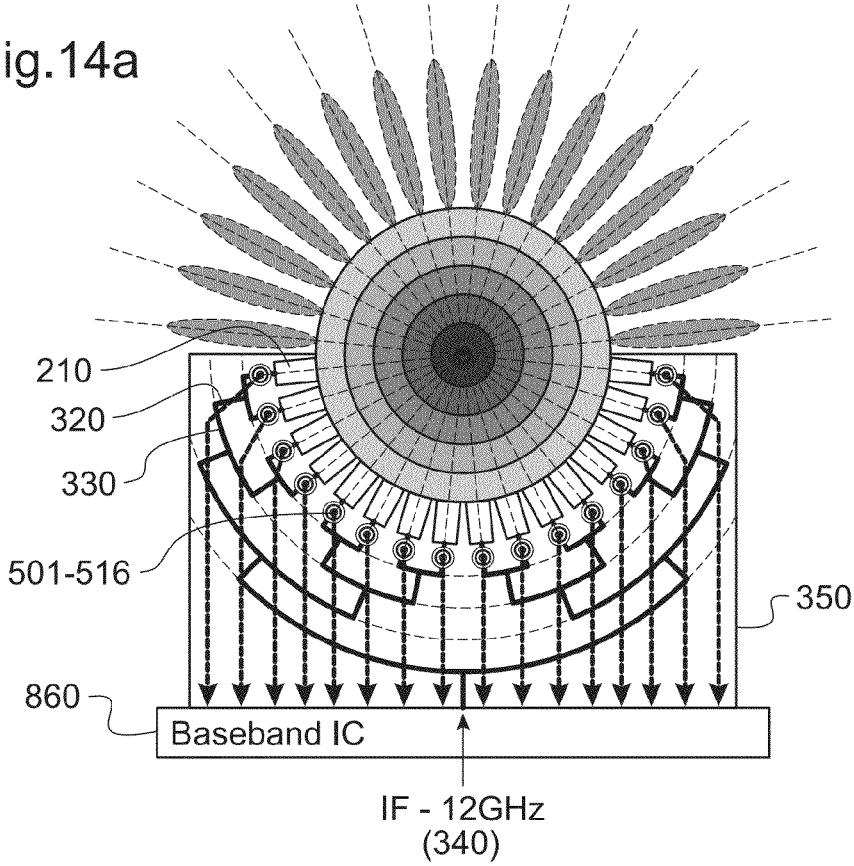
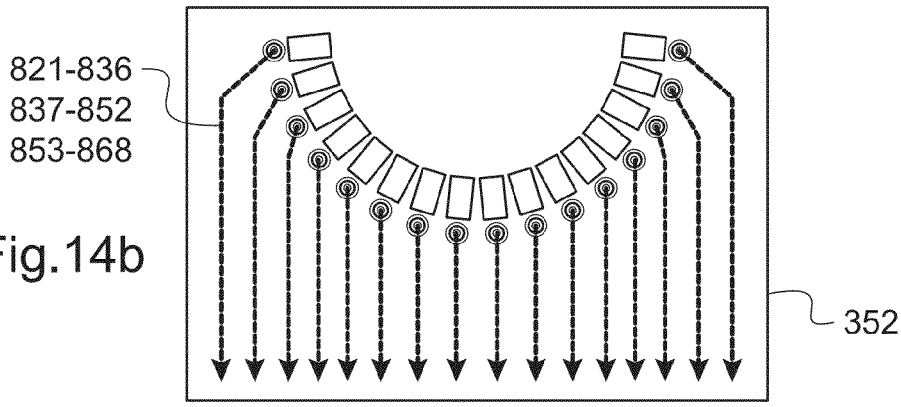
Fig.14b
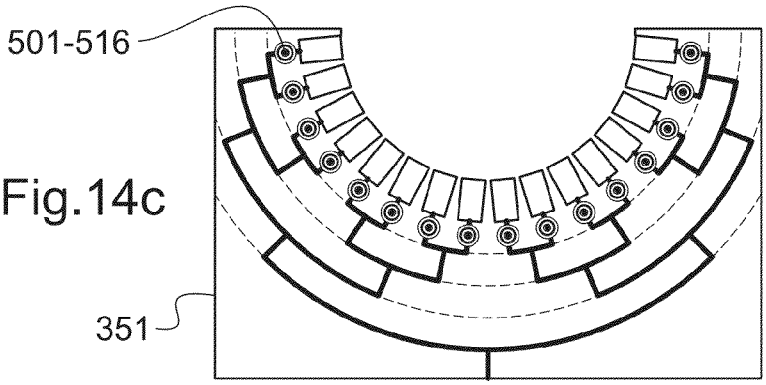
Fig.14c

CONCENTRIC MILLIMETER-WAVES BEAM FORMING ANTENNA SYSTEM IMPLEMENTATION

CROSS-REFERENCE TO RELATED APPLICATIONS

This application claims priority of UK patent application No. 1110356.1 filed on Jun. 20, 2011.

FIELD OF THE INVENTION

The invention relates to a millimeter-waves multi-beam forming antenna system having plenty of technical applications, in particular in the domain of communication devices.

BACKGROUND OF THE INVENTION

Communication devices, including digital cameras and high-definition digital camcorders are ubiquitously used and require an increasingly higher quality of service.

There is a growing need for reliable communication devices with high recording capacities that are user friendly and offer high image quality.

When images such as video and photographs are viewed on a display device including a HD (high-definition) television, the required bit rates for the transmission of data between the imaging device and the display device are in the range of several gigabits per second (Gbps).

Similar bit rates are necessary for the transmission of data between an imaging device and a storage device or physical carrier dedicated to the storage of multimedia data (audio and video data).

To prevent loss of quality during the transfer of images, a digital wire link such as an HDMI (high-definition multimedia interface) cable is at least necessary.

Indeed high-definition non-compressed multimedia data are transmitted in raw mode, it being understood that almost no processing and no compression is performed.

Raw data as recorded by the sensor of the imaging device can therefore be rendered without loss of quality.

Moreover, in home communication, raw data needs also to be transmitted almost in real time.

However, the use of a wired link in home communications systems has several drawbacks.

For example, a wired link between a camera and a television set has several limitations.

On the television set side, the connection systems may be difficult to access or may even not be available.

On the camera side, the connection systems are very small in size and may be concealed by covers, thereby making it difficult to connect the cable. In addition, it can be very difficult to move the camera or the screen when all devices are connected.

Similarly, in case cables are integrated in the walls of the house it is impossible to modify the installation. One approach for overcoming these drawbacks is the use of wireless connections between the communication devices.

However, said systems need to support data bit rates to the order of several Gigabits per second (Gbps). WiFi systems are operating in the 2.4 GHz and 5 GHz radio bands (as stipulated by the 802.11.a/b/g/n standard) and are not suited to reach the target bit rates. It is therefore necessary to use communications systems in a radio band of higher frequencies. The radio band around 60 GHz is a suitable candidate. When using an extensive bandwidth, 60 GHz radio communications systems are particularly well suited to transmit data at very high bit rates. In order to obtain high quality radio communications (i.e. low error bit rate) and sufficient radio range between two communication devices without having to transmit at unauthorized power levels, it is necessary to use directional (or selective) antennas enabling line of sight (LOS) transmission. Consequently, narrow beam forming techniques are necessary for wireless transmission with high throughput bit rate.

During the discovery phase, each pair of nodes of the wireless network has to initiate the communication parameters. It is therefore necessary to configure the antenna angle in order to obtain the best quality with the radio frequency (RF) link.

Communication parameters can be transmitted with a low bit rate and therefore allow decreasing needs in the budget of the RF link (e.g. antenna gain). This in turn allows a wide antenna beam to be formed in order to detect all the nodes within reach.

Consequently, the antenna has to form both a narrow and a wide beam during subsequent phases.

The antenna needed in the above-mentioned applications shall therefore be reconfigurable so as to obtain a narrow beam in azimuth, while having a large beam in elevation.

More specifically, the antenna required in such circumstances needs, by way of example, to satisfy the following requirements:

bandwidth: 57 to 64 GHz;

azimuth pattern: <15 degrees;

elevation pattern: >70 degrees;

azimuth pattern coverage (beam directivity): −70 to +70 degrees.

The problems described above, mainly refer to the setting up of very high bit-rate point-to-point wireless communications between a digital camera (DVC) and an HD television set. It is clear however that the problems may be extended to any context in which it is sought to set up wireless communications between a sender device being an imaging device and a receiver device being a device for data display or data storage.

The so-called smart antennas or reconfigurable antennas are used to reach the distances required by audio and video applications. A smart antenna mainly comprises a network (e.g. an array) of radiating elements distributed on a support. Each radiating element is electronically controlled in phase and power (or gain) in order to form a narrow beam or set of beams in sending and reception mode. Each beam can be steered and controlled. Consequently, this requires a dedicated phase controller and a power amplifier for each antenna element which increases the cost of the antenna.

In order to obtain a narrow beam, several antenna elements have to be powered, which may therefore result in significant consumption of energy. Power consumption is a serious handicap, especially for battery-powered portable devices.

In addition, the geometrical dimensions of the smart antenna are also a strong limitation to small portable devices.

The smart antennas known in the prior art comprise a network of radiating elements (for example 16) laid out in a square array on a substrate. The radiating elements have each a dimension of half the wavelength (i.e. 2.5 mm in case of 60 GHz range) and the space between the antennas elements has to be at least of one quarter of the wavelength. Consequently, the surface of a smart antenna is rather large, which is not very convenient for being integrated in portable devices. This leads to high costs, particularly when the materials used in the manufacture of the antenna comprise a substrate based on semiconductor technology. In the latter case, the final costs for mass market production of portable devices may be too high.

A planar steerable antenna using PCB patch is proposed by Sibeam (product SB9220/SB9210). This antenna sends energy in a large set of predefined directions. The number of possible directions is a function of the number of radiating elements.

However, many radiating elements are needed for such a design. Mutual inductance between the antenna elements is an important drawback for this technique and results in waste of energy through coupling. Also, the inherent symmetry causes energy to be sent in non desired directions. Another drawback is the necessity to adapt both the amplitude and the phase of the signal to be sent to each radiating element. Such an operation is costly at 60 GHz frequency.

In a know manner, spherical electromagnetic lenses are used in steerable antennas. The basic concepts are described by R. Luneburg (*Mathematical Theory of Optics*, Cambridge University Press, 1964). Spherical lenses are composed of dielectric materials having a gradient of decreasing refractive index. The relative dielectric constant of the lens (commonly referred to as Luneburg lens) follows the following rule:

$$\in_r(r)=2-(r/R)^2, \text{ for } r=0, \ldots, R;$$

and varies with the radial position r in the lens. Good control of the beam in azimuth is obtained through radiation into the lens of several thin beams along its edges. The Luneburg lens can be used in many applications mainly comprising radar reflectors and high altitude platform receivers. Spherical shapes of the lens are mainly used.

Two implementation techniques of the Luneburg lens are known and consist either in drilling holes as described in S. Rondineau, M. Himdi, J. Sorieux, *A Sliced Spherical Luneburg Lens, IEEE Antennas Wireless Propagat. Lett.,* 2 (2003), 163-166, or using variable dielectric materials in different shapes as described in WO 2007/003653.

Available commercial products are mostly alternatives of satellite dishes, being able to emit radiations at a low elevation. However, they are not suitable for applications requiring a constant angle in elevation and beam steering in azimuth.

Furthermore, beam forming and beam steering techniques are described in prior art. In WO2009013248, an antenna system is considered based on a lens being able to configure either a narrow beam or a sector-shaped (or wide) beam. The antenna system has a radiation diagram that can be reconfigured. This antenna is well adapted for the automotive radar application, but presents limitations for a wireless portable device. Their use in portable devices is not compatible due to the form and volume taken by the spherical or hemispherical lens. It is also difficult to manufacture said antennas from an industrial point of view. In particular, the assembly of the concentric homogeneous dielectric shells forming a spherical lens or hemispherical lens remains a problem. The number of the antenna sources in a given plane is also a strong limitation, particularly when considering the requirements for the azimuth angle of 160° and 10° for the narrow beam in 16 different directions. This implementation is thus not suitable.

Another solution is proposed in US 2008048921 where the antenna can generate multiple beams.

A current problem, known in the prior art relates to the design of antennas capable of beam forming (directional lobes) both in transmission and reception and concerns the interconnections between the individual radiating elements of the antenna array and the electronic circuit. In section VII of the article entitled: *Design of millimetre-wave CMOS radio, IEEE Transaction circuit and system—vol.* 56 *No* 1 January 2009, the authors emphasise the problem of interconnections generating both phase shifts and signal amplitude level shifts, while creating additional losses and spurious couplings that are detrimental to the intrinsic characteristics of the antenna. In addition, it is even more difficult to design feeder circuit routing guaranteeing accuracy during manufacturing.

SUMMARY OF THE INVENTION

The invention has been devised with the foregoing in mind.

According to a first aspect, the invention concerns an antenna that comprises an electromagnetic lens and at least one electromagnetically shielding member. The electromagnetic lens is adapted to guide at least one electromagnetic signal by means of at least a variation in permittivity, wherein the electromagnetic lens comprises an inner part and an outer part, said inner part containing a plurality of holes and said outer part comprising at least a homogeneous layer (made e.g. of a foam material).

The at least one electromagnetically shielding member encapsulates the electromagnetic lens partially so as to direct at least one electromagnetic signal propagating through the electromagnetic lens.

As emphasized above, the electromagnetic lens is adapted to guide at least one electromagnetic signal by means of at least said variation in permittivity. The term "guide" is also to be understood in the sense that the electromagnetic signal is directed. The at least one shielding member guides the at least one electromagnetic signal in a direction substantially parallel to the variation in permittivity of the lens. Thus, directing the signal partly contributes to making the multi-beam antenna capable of controlling a large elevation pattern of the main beam while ensuring a narrow beam in azimuth. This antenna will be able to orient said narrow beam within a very large sector in azimuth. Thanks to this second guidance effect, an antenna according to the invention can thus be steered on a wide span.

It is further to be emphasized that the shielding member encapsulating partially the electromagnetic lens, is a totally new and innovative concept. Said encapsulation is basically adapted to direct the at least one electromagnetic signal. The term "direct" is to be understood here in the sense that the electromagnetic signal is guided through the encapsulated electromagnetic lens and said guidance partly contributes to allow the multi-beam antenna to control a large elevation pattern of the main beam while ensuring a narrow beam in azimuth. Such an antenna will be able to orient said narrow beam within a very large sector in azimuth. Antennas according to the invention can thus be widely steered in the range as described and are thus largely reconfigurable.

The outer part may be formed as a superposition of a plurality of homogeneous layers, each having a different permittivity. As a possible variation, the outer part may be formed of a single layer.

The homogeneous layers of the outer part of the electromagnetic lens may then be made of different foam materials, each foam has having a specific permittivity. In a possible particular implementation of the antenna, the electromagnetic lens may have a cylindrical shape. In such a case the homogeneous layers can then be advantageously adapted to be substantially concentric around the symmetry axis of said electromagnetic lens.

The invention according to the above first aspect is adapted to antennas that are to be used in both emission and reception mode. Said bidirectional antennas implementing the first aspect of the invention comprise at least one antenna transmission mean, adapted to radiate an electromagnetic signal into the lens and to receive an electromagnetic signal therefrom.

In another possible particular implementation of the invention, the at least one antenna transmission means comprises at least one wave guide adapted to guide the electromagnetic signal to the lens and the electromagnetic signal received therefrom.

In a further implementation of the particular implementation of the invention, the at least one wave guide can be part of the at least one electromagnetically shielding member.

In a possible particularly interesting implementation of the invention, the at least one electromagnetically shielding member is part of an enclosure and said enclosure encapsulates partially the electromagnetic lens.

Moreover, the enclosure may be adapted to comprise an enclosure body and an enclosure boundary portion, where said enclosure encapsulating partially the electromagnetic lens comprises the at least one electromagnetic shielding member.

In a possible particular implementation of the antenna, the enclosure body comprises plastic material and the at least one electromagnetically shielding member is a metallized part of the enclosure boundary portion.

In a possible implementation of the invention, the enclosure encapsulating partially the electromagnetic lens comprises metallic material and the at least one electromagnetically shielding member is the whole enclosure.

In said possible implementation of the antenna, the at least one antenna transmission means may advantageously comprise at least one ridged wave guide, provided in the metallic enclosure encapsulating at least partially the electromagnetic lens.

In another possible particular implementation of the invention the enclosure body comprises ceramic substrate and the at least one electromagnetically shielding member is a metallized member of the enclosure boundary portion. In the latter implementation, the at least one antenna transmission means can advantageously comprise at least one wave guide integrated into the substrate by using Substrate Integrated Waveguide (SIW) techniques.

According to the above possible particularly interesting implementation of the invention, the antenna may comprise mechanical locking means for simple and easy adjustment and locking of the electromagnetic lens in the enclosure. Said locking means may advantageously comprise either at least one wiring means surrounding partially the electromagnetic lens and locking it in the enclosure or at least one pin and a corresponding recess for accommodating each pin where both are adapted to lock the electromagnetic lens in the enclosure. Said at least one pin and recess are respectively part of the electromagnetic lens and the enclosure or vice versa.

According to another aspect, the invention is directed to an antenna which comprises an electromagnetic lens, a plurality of antenna transmission means, each being adapted to radiate an electromagnetic signal into the electromagnetic lens, a common circuit adapted to supply an electrical signal and conveying means which are adapted to convey the electrical signal between the common circuit and each of the plurality of antenna transmission means. Said conveying means are configured to make the propagation time of the electrical signal between the common circuit and each respective antenna transmission means substantially equal.

In a possible particular implementation of the foregoing, the geometrical form of the conveying means represents a tree structure adapted to make substantially equal the length of each path followed by the feeding electrical signal from the common circuit to each respective antenna transmission means.

Furthermore, the particular implementation can advantageously be adapted so that the branches of the tree structure representing the geometrical form of the conveying means substantially follow a path obtained after applying at least one linear transform to the geometrical boundary of the electromagnetic lens.

In case the electromagnetic lens has a cylindrical shape, the branches of the tree structure representing the geometrical form of the conveying means are located in a plane perpendicular to the symmetry axis of said electromagnetic lens and comprise at least one arc being part of at least one concentric circle located around the circular intersection of the electromagnetic lens with said plane.

It may be provided that at least one electromagnetically shielding member encapsulates the electromagnetic lens partially so as to direct at least one electromagnetic signal propagating through the electromagnetic lens.

The electromagnetic lens may comprise media of varying permittivity and said electromagnetic lens may then be adapted to guide at least one electromagnetic signal by means of at least said variation in permittivity.

The at least one electromagnetically shielding member may guide at least one electromagnetic signal in a direction substantially parallel to the variation in permittivity of the electromagnetic lens.

The electromagnetic lens may comprise an inner part and an outer part, said inner part containing a plurality of holes and said outer part being formed of at least one homogeneous layer, e.g. as a superposition of a plurality of homogeneous layers, each having a different permittivity.

Each homogeneous layer of the outer part of the electromagnetic lens may then be made of a different foam material, each foam material having a specific permittivity.

Other features presented above in connection with the first aspect may also apply to the antenna just mentioned.

BRIEF DESCRIPTION OF THE DRAWINGS

Other features and advantages will emerge from the following description given by way of a non-limiting example with reference to the accompanying drawings in which:

FIG. 1*a* represents a preferred embodiment of a multi-beam antenna according to the invention, said antenna comprises an electromagnetic lens having a circular shape and an electromagnetically shielding member encapsulating the electromagnetic lens partially.

FIG. 1*b* illustrates a cross-section of the preferred embodiment of a multi-beam antenna according to the invention as shown in FIG. 1*a*.

FIG. 2 illustrates a detailed implementation of the electromagnetic lens according to the invention where the electromagnetic lens has a circular shape and comprises an inner part and an outer part, said inner part contains a plurality of holes and said outer part is formed as a superposition of two concentric homogeneous layers, each layer has a different permittivity and is made of a different foam material with specific permittivity.

FIG. 6*d*) shows a slot antenna (resp. a patch antenna) as part of the conveying means of the antenna transmission means, being adapted to radiate an electromagnetic signal into the electromagnetic lens and to receive an electromagnetic signal therefrom.

FIG. 8 is a schematic view of an implementation of the invention comprising sixteen (16) antenna transmission means arranged concentrically around the cylindrically shaped electromagnetic lens.

FIG. 9 illustrates a variant of a multi-beam antenna according to the invention. Sixteen (16) antenna transmission means are arranged around the electromagnetic lens, each being adapted to radiate an electromagnetic signal into the electromagnetic lens; in this implementation a common circuit is adapted to supply an electrical signal. Conveying means are designed to carry the electrical signal between the common circuit and each of the antenna transmission means. Said conveying means are configured to make the propagation time of the electrical signal between the common circuit and each respective antenna transmission means substantially equal. This is achieved in a preferred implementation, through the geometrical form of the conveying means that assumes the shape of a tree structure adapted to make substantially equal the length of each path followed by the feeding electrical signal from the common circuit to each respective antenna transmission means. The geometrical form of the conveying means substantially follows a path obtained after applying at least one linear transform to the geometrical boundary of the electromagnetic lens. With an electromagnetic lens having a cylindrical shape as represented in FIG. 9, the branches of the tree structure representing the geometrical form of the conveying means are located in a plane that is perpendicular to the symmetry axis of said electromagnetic lens and comprise several arcs being part of concentric circles located around the circular intersection of the electromagnetic lens with said plane.

FIGS. 11*a-b* illustrate an implementation of a narrow beam forming antenna with its associated measured radiation pattern (FIG. 11*b*).

FIGS. 12*a-c* show the radiation patterns obtained through the use of three active antenna transmission means (FIG. 12*a*).

FIGS. 13*a-b* show the radiation pattern obtained through the use of sixteen active antenna transmission means (FIG. 13*a*).

FIGS. 14*a-c* illustrate different views of a variant of the preferred embodiment showing an implementation of the antenna that is adapted to operate both in emission and in reception modes.

DETAILED DESCRIPTION OF EMBODIMENTS OF THE INVENTION

Figure 3A:
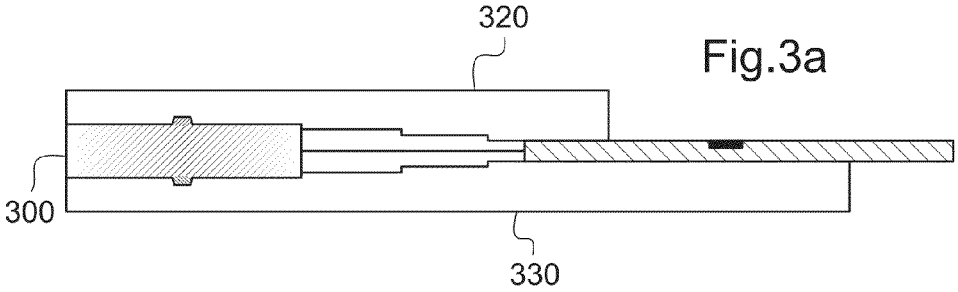
FIG. 3*a* represents a mounted multi-beam antenna comprising an electromagnetic lens together with locking means consisting of single pins being part of the electromagnetic lens and corresponding recesses being part of the enclosure body.

An embodiment of a multi-beam antenna according to the invention is represented in FIG. 1*a* and comprises an electromagnetic lens 200 having a substantially cylindrical shape. By way of example, the relative dimensions (form factor) of the electromagnetic lens are as follows:

diameter/height=9.33.

The diameter of the electromagnetic lens 200 is for example of 28 mm and this value is chosen so as to obtain a beam having an azimuth pattern (3 dB) of less than 15 degrees and approximately 10 degrees. This value is obtained from the two following equations;

$$G = \frac{32000}{\theta_E \theta_A}$$

$$G = 10\log\left(\frac{\Pi \cdot D}{\lambda}\right)^2$$

where G, $\theta_E$, $\theta_A$, D, λ stand for quantities expressed in units as indicated herebelow:

G, dimensionless antenna gain;

$\theta_E$, elevation angle in degrees;

$\theta_A$, azimuthal angle in degrees;

D, diameter of the electromagnetic lens in meter;

λ, wavelength in meter.

In the embodiment considered here, the following values from are taken on from which results the diameter D as chosen:

$\theta_E$=70 degrees;

$\theta_A$,=10 degrees;

λ=4.49 $10^{-3}$ m.

As schematically represented in FIG. 1*a*, the electromagnetic lens 200 is encapsulated partially by an electromagnetically shielding member contained here in a two-part enclosure. Alternatively, the electromagnetic lens may be enclosed within:

a one-part enclosure or casing; or in an enclosure or casing having more than two parts.

The two-part enclosure represented in FIG. 1*a* comprises an upper part 120 and a lower part 130 each partially surrounding or bounding the electromagnetic lens. In this embodiment the upper and lower parts are maintained together by means of screws 110, 115 and those to be inserted in the hole 145 and following holes.

This enclosure comprises metallic material.

The multi-beam antenna comprises e.g. sixteen (16) antenna transmission means. Each antenna transmission means comprises ridged wave guides 125 that are formed in the metallic enclosure encapsulating the electromagnetic lens. The metallic enclosure directs the electromagnetic signal and guarantees that a beam has a controlled opening in elevation. This opening depends solely on the cylinder height. The azimuth pattern of the beam is, in turn, determined by the parameters selected for the determination of the diameter of the cylinder according to the preceding equations.

The antenna transmission means are arranged around the circumference of the cylindrically-shaped electromagnetic lens. As the revolution form creates space, the waveguides are part of the antenna transmission means and are not generating mutual inductance. There is no planar symmetry in the preferred embodiment, thereby avoiding waste of energy. The power consumption of the antenna system is thus reduced.

The upper part 120 and lower part 130 of the electromagnetically shielding member maintain therebetween a Printed Circuit Board 150 (referred to as PCB 150), carrying the conveying means which are adapted to convey the electrical signal between respective circuits of PCB 150 and the antenna transmission means. For the sake of clarity the conveying means are not represented here in FIG. 1*a*.

Antenna transmission means can possibly be made by using well known techniques such as Microstrip or Co Planar Waveguide (CPW) lines.

As represented in FIG. 1*a*, two (2) screws 110 enable fastening of PBC 150 to the lower part 130 of the enclosure. As to the upper part 120, seventeen (17) screws (one being represented with reference 115 and the remaining are to be inserted in the hole 145 and the following ones) attach the upper 120 and lower part 130 of the enclosure together. The holes 145 and following ones are drilled in between the plurality of cavities formed by parts 120 and 130. In the embodiment considered here, the seventeen (17) holes are interleaved by the sixteen (16) cavities. The number of waveguides 125, as well as the number of assembling/mounting screws 115 (and those to be inserted in the holes 145 and following) are given here as non-limitative examples. These numbers are the result of the specification for a beam covering a width of 140 degrees, and may thus vary according to the needs. They are given only by way of example and should not be considered as limitative. The aim is to obtain a perfect contact between the two parts of the enclosure without any air gap in between these parts of the enclosure.

FIG. 1*b* is a cross-section view of the corresponding antenna as represented in FIG. 1*a*. The cross section is taken along the ridge of one of the waveguides 125. In FIG. 1*b*, PCB 150 is represented as being clamped between the two parts 120 and 130 of the metallic enclosure. An internal cavity 160 is formed thanks to the stepped recesses provided in the internal faces of the two parts 120 and 130 of the metallic enclosure. Cavity 160 constitutes a ridged waveguide. The cylindrical shaped electromagnetic lens is partially encapsulated by an upper part 120 and a lower part 130 of the enclosure, thereby leaving free a side or peripheral wall of the lens. For the sake of clarity, these holes 145 and following (represented in FIG. 1*a*) are not shown in the cross-section (FIG. 1*b*).

The electromagnetic lens comprises media having a varying permittivity and is adapted to guide electromagnetic signals by means of said variation in permittivity. The term "guide" means that the electromagnetic signal propagation through the lens is directed thanks to the variation in permittivity. It is to be noted that the signal is guided in a direction that is substantially parallel to the variation in permittivity of the lens thanks to the shielding member (enclosure). This guidance contributes to making the multi-beam antenna capable of controlling a large elevation pattern of the main beam while ensuring a narrow beam in azimuth and also capable of orienting said narrow beam within a very large sector in azimuth. Antennas according to the invention can thus be widely steered in the above range.

In a particular implementation, the electromagnetic lens comprises an inner part and an outer part, said inner part contains a plurality of holes and said outer part is formed in the present example as the superposition of several homogeneous layers, each having a different permittivity. The homogeneous layers of the outer part of the electromagnetic lens are here made of different foam materials, each foam material has a specific permittivity.

In the preferred embodiment, the electromagnetic lens is cylindrical in shape and the homogeneous layers are concentric around the symmetry axis of said electromagnetic lens.

FIG. 2 shows a cross-section of an implementation of the cylindrically-shaped electromagnetic lens 200 as used in the preferred embodiment. The height H of the electromagnetic lens 200 cylinder is for example of three millimeter.

The inner part of electromagnetic lens 200 is a core cylinder 210, made of Teflon® and holes are drilled through cylinder 210 according to the rules outlined hereafter. The relative permittivity of Teflon® material is for example as follows:

$$\epsilon_r=2.04.$$

The outer part of the electromagnetic lens comprises two concentric layers. The first (central) layer 220 is made of a crown made of foam material having a relative permittivity for example as follows:

$$\epsilon_r=1.45.$$

The second (peripheral) layer 230 is made of a crown made of a foam material having a relative permittivity for example as follows:

$$\epsilon_r=1.25.$$

The foam material can possibly be Emerson and Cuming Eccostock® or DIAB divinycell®.

Holes are drilled in the inner part of the electromagnetic lens, with a diameter of 0.4 mm. The drilling rules are given first by dividing the surface of the lens into several subsections, then holes are positioned so that the ratio of the volume of the air over the total volume that is under the sub-section surface and the ratio of material volumes over the total volume under the sub-section multiplied by their respective permittivity leads to an average permittivity which is defined by the Luneburg law outlined in S. Rondineau, Himdi, J. Sorieux, *A Sliced Spherical Luneburg Lens, IEEE Antennas Wireless Propagat. Lett.,* 2 (2003), 163-166.

It is recommended not to drill following a line or a radius if a given mechanical strength is to be obtained.

It is important to emphasize that, according to the prior art, an implementation of an electromagnetic lens having drilling holes may result in a fragile lens as many holes are necessary near the boundary of the electromagnetic lens. Consequently, such lenses are fragile and their construction may even not be feasible. The implementation of the electromagnetic lens in a two-part construction (inner part with holes and outer part comprising at least a homogeneous layer) provides a new and novel contribution to the prior art. Moreover, the assembling of the electromagnetic lens according to the invention does not require any glue material as the cylindrical lens is locked in the enclosure (crown). Besides costs aspects, if glue is used to assemble the foam layers together, this may modify the permittivity of the foam. Moreover, as the inner part of the cylinder is in plain material according to the invention, it can mechanically and reliably support locking means for fixing the electromagnetic lens to the enclosure.

The variation in permittivity is implemented through the presence of air in the drilled holes or in the foam. Thermal dissipation is thus facilitated, resulting in an efficient transmission of power. In addition, the electromagnetic lens is easy to be assembled and can be carried out in various low cost technologies as outlined hereafter and at various frequencies according to the preceding formulas expressing the relations between antenna gain, the elevation and azimuth angles, the diameter of the electromagnetic lens and the wavelength.

In the first preferred embodiment, the enclosure (shielding member) is made of metallic material that is micro-machined so as to form the ridged waveguides.

Alternatively, the enclosure body is made of molded plastic and the electromagnetically shielding member is a metallized part of the enclosure boundary portion. Although metallized plastic waveguides are seldom used, experiments show that these techniques can successfully be applied. The plastic material can be loaded with metallic particles. In such implementations, the enclosure boundary portion has to be appropriately metallized. This can advantageously be obtained by using electroplating techniques.

In view of mass production of easy mounting and positioning of the constituting parts of the antenna is of interest.

In this respect, the antenna may comprise locking means for locking said electromagnetic lens in the enclosure. Said locking means may advantageously comprise either at least one wiring means surrounding partially the electromagnetic lens and locking it in the enclosure or at least one pin and a corresponding recess for accommodating each pin and that are both adapted to lock the electromagnetic lens in the enclosure, said at least one pin and recess being respectively part of the electromagnetic lens and the enclosure or vice versa.

Figure 3B:
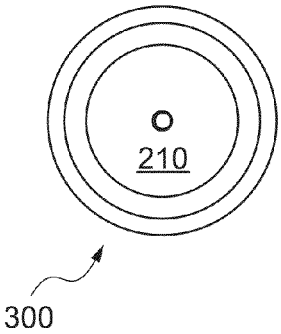
FIG. 3*b* is a top view of the electromagnetic lens provided with a pin.
Figure 4A:
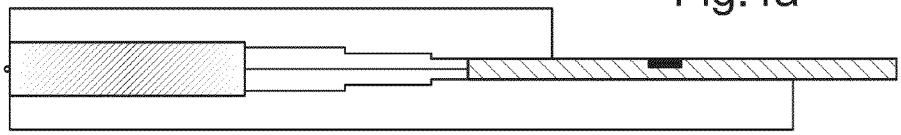
FIG. 4*a* illustrates a mounted multi-beam antenna comprising the electromagnetic lens and locking means consisting of wiring means surrounding partially the electromagnetic lens and locking it in the enclosure.
Figure 4B:
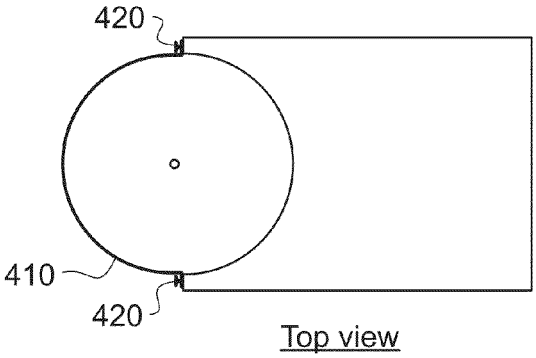
FIG. 4*b* is a top view of the FIG. 4*a* antenna.

Mounting means are represented by way of example in FIG. 3 where the electromagnetic lens 300 comprises two centering pins, one on the upper part (upper face) and one on the lower part (opposed lower face) of the electromagnetic lens while the enclosure encapsulating partially the electromagnetic lens comprises corresponding recesses in the upper part 320 (lower face) and lower part 330 (upper face) thereof. The dimensions of each pin and corresponding recess are complementary to each other. In a preferred example, the height of the penetrating pin in the recess is less than a tenth of the wavelength in order not to alter the electromagnetic characteristics FIGS. 4*a-b* illustrate two views of an alternative embodiment for the locking means of FIG. 3. Here, the locking means comprise wiring means. More particularly, wire 410 is made of a dielectric material having a permittivity close to one (1) or alternatively is made of a material, similar to those constituting the peripheral crown, thus avoiding a significant variation in permittivity. The wire 410 is partially encircling the cylindrically-shaped electromagnetic lens 200 and is attached to the enclosure body encapsulating partially said electromagnetic lens 200 (see top view in FIG. 4*b*). The attachment can be achieved through the use of pins 420 clamping the wire 410 to said enclosure body.

In another variant, the enclosure comprises an enclosure body and an enclosure boundary portion body comprises ceramic substrate and the at least one electromagnetically shielding member is a metallized member of the enclosure boundary portion. In this implementation, the plurality of antenna transmission means may advantageously comprise one or several wave guides integrated into the substrate by using for example Substrate Integrated Waveguide (SIW) techniques.

Figure 5A:
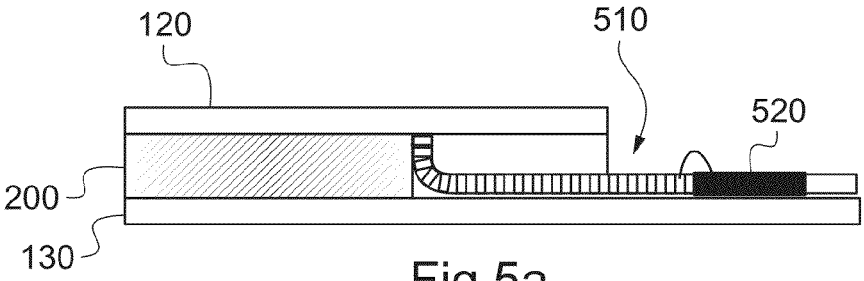
FIGS. 5*a* and 5*b* represent an alternative implementation of a multi-beam antenna wherein three antenna transmission means comprise each a wave guide being integrated into the substrate by using a Substrate Integrated Waveguide (SIW) techniques.
Figure 5B:
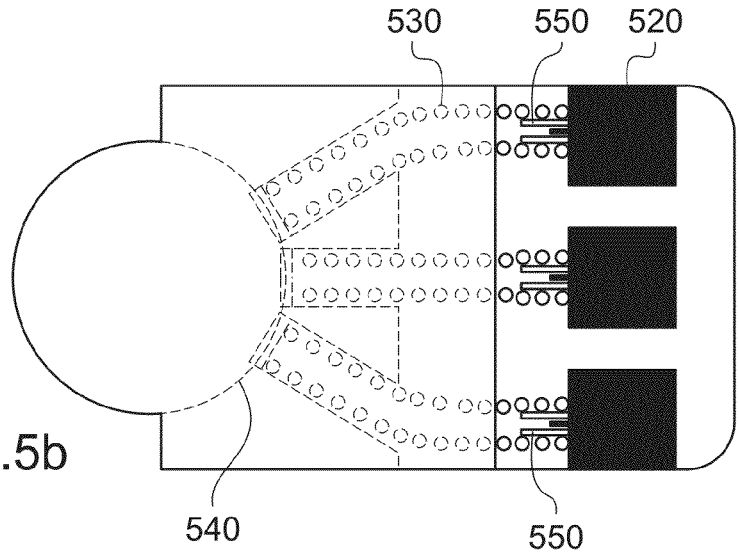

FIGS. 5*a-b* represent a cross-section and a top view of an embodiment where the enclosure is made of multi-layer ceramic and the conveying means are made through the use of said Substrate Integrated Waveguide technique. Advantageously, this technique provides a better integration as well as an increased efficiency. Instead of using metallic parts, the enclosure body 120 and 130 can here possibly be made either of glass, or of Low Temperature Co fired Ceramic, or High Temperature Co Fired ceramic. A metallic layer forms the electromagnetic shielding member and is part of the enclosure boundary portion. Said metallic layer is on the inner faces of the enclosure (lower and upper faces) that are in contact with the electromagnetic lens 200.

The Substrate Integrated Waveguide implemented in this variant may be made of a thin substrate made of Dupont Kapton® or Rogers® materials laminated and tied together with two layers of metal. This implementation offers flexibility and excellent physical characteristics at high frequencies.

The circuits 520 that generate the electrical signal are active devices that have to be glued onto the lower metallized layer of the Substrate Integrated Waveguide 510. On the upper metallic layer of the Substrate Integrated Waveguide 510, certain trenches 550 (hole having a rectangular form, obtained by etching) can be provided in order to obtain a CPW form. Alternatively, micro-strips can advantageously be used to connect to active circuits. A CPW form is considered as a strip of copper on a surface of insulating material. This strip is surrounded by a limited absence of copper (the trench). The copper following the trench is tied to ground. A microstrip has an unlimited absence of copper surrounding it. The ground layer is on the other side of the insulating material. The electrical field stays above the substrate in CPW, while it goes through in microstrip.

Each integrated Waveguide 510 is bounded by metallized holes 530 (also referred to as posts or vias). The metallized holes 530 penetrate the whole substrate, thus forming an electromagnetic barrier. The waveguides constructed in this way represent the conveying means of the antenna transmission means and convey an electrical signal output by circuit(s) 520 to the lens. The lens may be provided with trenches 540 that mechanically retain each a corresponding Substrate Integrated Waveguide. It is to be stressed here that SIW technologies together with the construction of waveguides by using metallized holes, considerably reduce the costs and moreover enable miniaturization of the antenna.

Furthermore, FIGS. 6*a-d* show additional details to the Substrate Integrated Waveguide technique that may be applied, in addition either to a multilayer ceramic technique or to a metallic mounting technique.

Figure 6A:
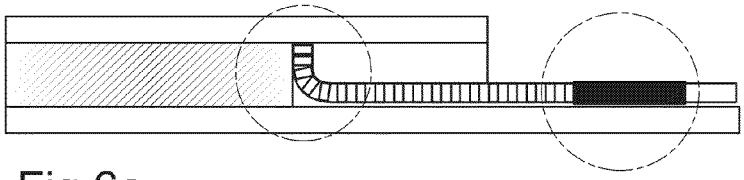
FIGS. 6*a-d* illustrate different views of the multi-beam antenna of FIGS. 5*a* and 5*b*. More particularly, the connection between the active device (being a power amplifier or a low noise amplifier) and the waveguide of the conveying means is formed by a bond wire and a micro-strip as shown in FIG. 6*b*. The FIG. 6*c* (resp.
Figure 6B:
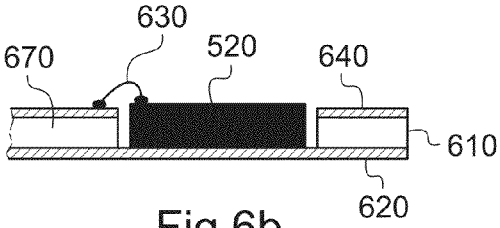
Figure 6C:
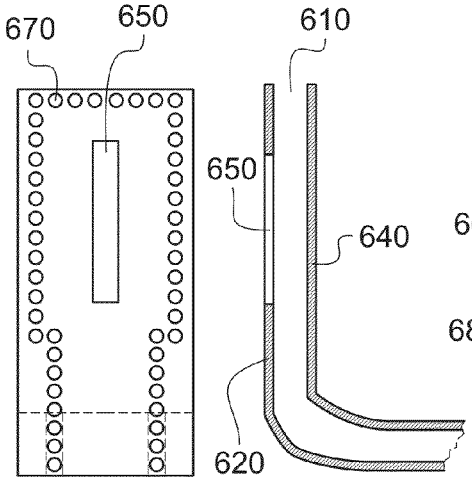

In FIG. 6*b*, the metallized through holes 670 form a barrier confining the electromagnetic wave with the help of the two metallic horizontal layers. The latter are connected to active devices 520 via a bond wire 630 that is soldered. In order to achieve the transition, copper is removed to obtain a Co Planar Waveguide form. A transition occurs whenever the device carrying the waveform is replaced by another one, e.g. a waveguide to CPW or CPW to microstrip form a transition. The bond wire is tied to the beginning of the CPW line and the Substrate Integrated Waveguide is powered by the other end of the CPW line. The bond goes to the upper layer 640. The substrate 610 is, by way of example, made of Dupont Kapton® or Rogers® laminated material. FIG. 6*c* shows the other part of the antenna transmission means which are in contact with the electromagnetic lens. This part comprises a trench made in the electromagnetic lens 200, while the Substrate Integrated Waveguide forms a slot antenna. The slot 650 is obtained by removing copper from the lower layer 620. This can be achieved thanks to the properties of the waveguide. Indeed, active layers can be inverted between the input of the waveguide and its output. It is important to highlight here that the Substrate Integrated waveguide is thus directly in contact with the electromagnetic lens through the slot 650.

Figure 6D:
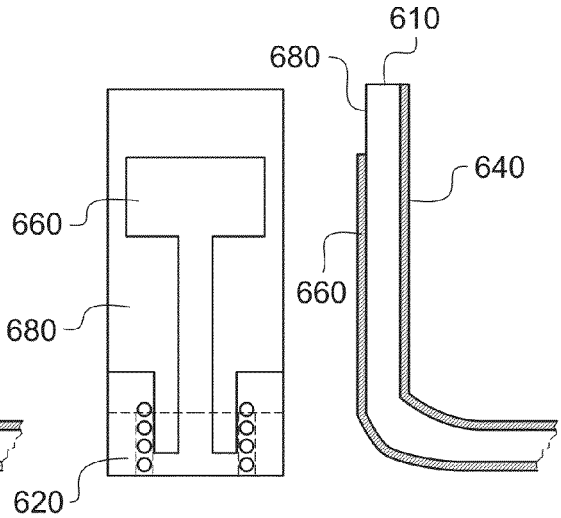

FIG. 6*d* represents an alternative implementation of the slot antenna, where the Substrate Integrated Waveguide excites a patch antenna. The patch 660 is obtained by removing the copper from the lower layer 620 of the surface as shown by the reference 680. The patch 660 (square form) radiates. The feeding microstrip modifies this radiation.

The dimensions of the above implementations may vary and basically depend on the frequencies of the application and the dielectric permittivity that is used. The dimensions of the slot and the patch described above are basically sized so as to be of half a wavelength in the dielectric material. It is to be noted that these basic dimensions are slightly modified to take into account the effects of edges.

The length of the slot may advantageously be a fifth of the wavelength, if half the wavelength is considered as too great. The other dimension of the path or the slot defines the impedance of the antenna. Further design and sizing criteria can be found in the book entitled: *Advanced Millimeter Wave Technologies: antennas, packaging and circuits*, Ed: D. Liu, B. Gaucher, U. Pfeiffer and J. Grzyb, Wiley 2009.

For the SIW, the distance between the metallized holes is lower than a quarter of the wavelength in the dielectric material. A plurality of via lines can be used to reduce the inter-post dimension.

Figure 7A:
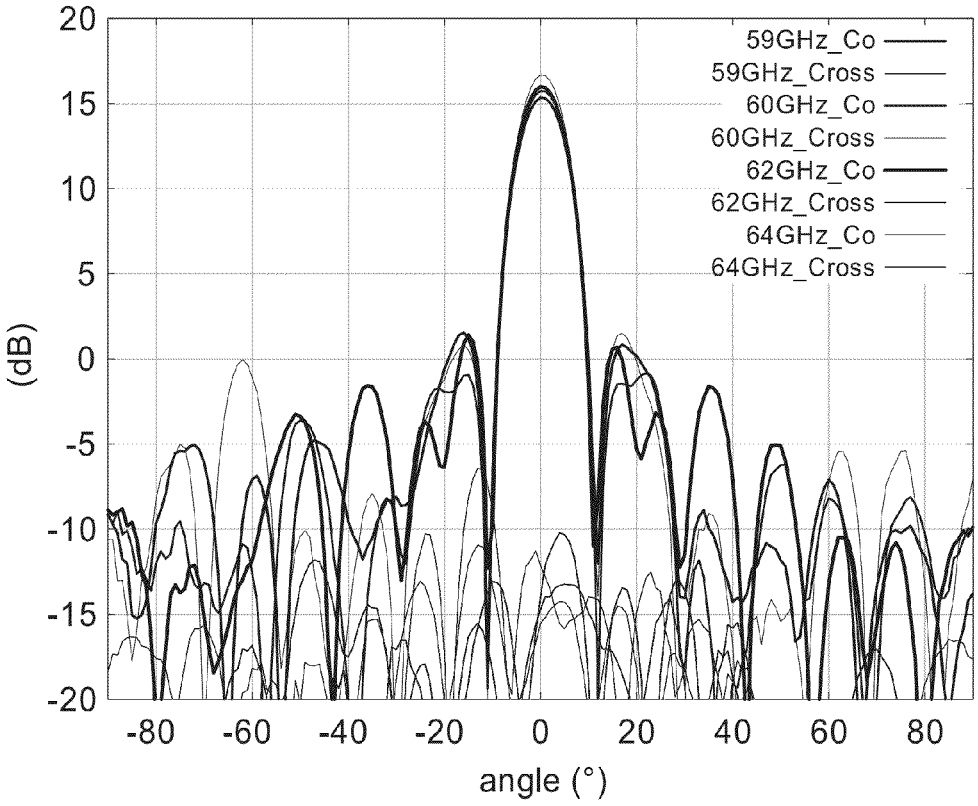
FIG. 7*a* is a graph showing the measured radiation patterns in azimuth of the preferred embodiment of the multi-beam antenna according to the invention. Co-polarization (solid line) and cross polarization (dash line) for frequencies between 59 GHz and 64 GHz are shown.

FIG. 7*a* represents the measured radiation patterns in azimuth of the multi-beam antenna as illustrated in FIG. 1. A gain of 15 dB is obtained and the angle of the beam (width of the beam) is close to 10 degrees.

Figure 7B:
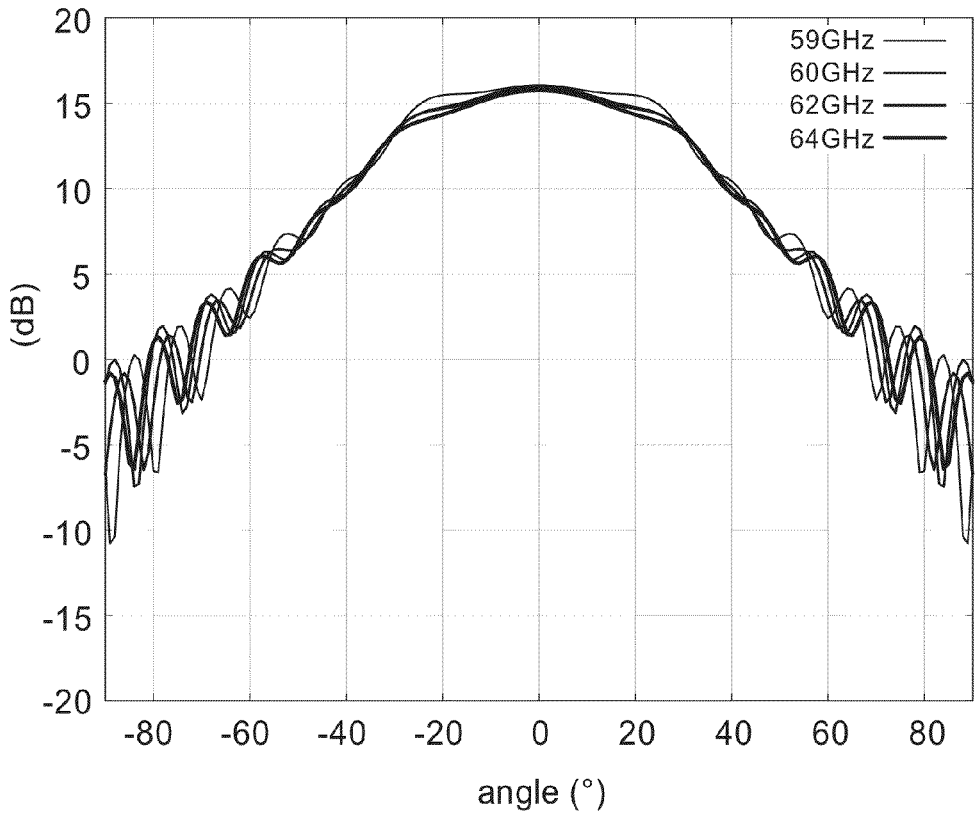
FIG. 7*b* is a graph showing the measured radiation patterns in elevation of the preferred embodiment of the multi-beam antenna according to the invention. Co-polarization (solid line) and cross polarization (dash line) for frequencies between 59 GHz and 64 GHz are shown.

FIG. 7*b* represents the measured radiation patterns in elevation of the multi-beam antenna as illustrated in FIG. 1. The width of the beam is close to 58 degrees at 60 GHz.

According to another aspect of the invention, the antenna comprises an electromagnetic lens, a plurality of antenna transmission means, each being adapted to radiate an electromagnetic signal into the electromagnetic lens. It may be preferable to have a common circuit adapted to supply an electrical signal (which may be a single signal) and conveying means adapted to convey the electrical signal between the common circuit and each of the plurality of antenna transmission means. More particularly, the conveying means are configured to make the propagation time of the electrical signal between the common circuit and each respective antenna transmission means substantially equal.

According to a possible feature, the geometrical form of the conveying means assumes the shape of a tree structure adapted to make substantially equal the length of each path that is followed by the electrical signal from the common circuit to each respective antenna transmission means.

Furthermore, the branches of the tree structure representing the geometrical form of the conveying means may substantially follow a path that is obtained after applying at least one linear transform to the geometrical boundary of the electromagnetic lens. In case the electromagnetic lens has a cylindrical shape, the branches of the tree structure representing the geometrical form of the conveying means are located in a plane that is perpendicular to the symmetry axis of said electromagnetic lens and comprise at least one arc which is part of at least one concentric circle located around the circular intersection of the electromagnetic lens with said plane.

This further aspect of the invention is represented in FIG. 8. As illustrated, a multi-beam antenna comprises sixteen (16) antenna transmission means comprising each a waveguide 210. The waveguides 210 are arranged concentrically around the cylindrically-shaped electromagnetic lens 200. Metallic plates 220 cover the electromagnetic lens on both opposite sides of the electromagnetic lens and form an enclosure which is the electromagnetically shielding member.

FIG. 9*a* shows further details of this aspect. The electromagnetic lens 200 comprises five (5) concentric homogeneous layers 201, 202, 203, 204 and 205. These homogeneous layers are optimized in terms of radius and corresponding dielectric constant:

Layer 1 (external): $\in_{r1}=1.18$
Layer 2: $\in_{r2}=1.36$
Layer 3: $\in_{r3}=1.55$
Layer 4: $\in_{r4}=1.73$
Layer 5 (center): $\in_{r5}=1.91$ where $\in_{ri}$ for i=1, . . . , 5 is the relative permittivity of the dielectric materials and $r_1 \ldots r_5$ the radius of the respective shells/crowns.

The distance between the electromagnetic lens and the common circuit (adapted to supply an electrical signal) has to be taken into account in order to optimize radiation and directivity. As all the focus points are located on the external surface (peripheral or side surface) of the electromagnetic lens, there is a need that each focus point fits well with the phase centre of the waveguides. The phase center is to be understood as the apparent point from which the electromagnetic signal spreads in all the direction with a constant phase. Here at the output (end of the wave guide), the origin point (phase center) of the main radiating lobe merges with the lens focus point. The output of the waveguide is therefore very close to the electromagnetic lens.

Other antenna sources can advantageously be used, such as Tapered Slot Antenna (TSA), or Substrate Integrated Waveguide.

A specific design of the substrate 350 is achieved according to the invention and comprises conveying means that keep unchanged the phase and the amplitude of the electrical signal between the common circuit and the antenna transmission means. Substrate 350 can be advantageously implemented by using several technologies including but not limited to: Radio Frequency Printed Circuit Board (RF PCB), Thermoset Microwave Materials (TMM) or High Temperature Co-fired Ceramic (HTCC). This is basically possible due to the good electromagnetic properties such as the low dielectric value and low dielectric loss of said materials.

The waveguides 210 or likewise certain radio front-end circuits comprise electrical tracks 320, 330 that are printed on the substrate 350. These printed electrical waveguides or lines have adapted impedance and supply a radio frequency (RF) electrical signal or the master Local Oscillator (LO) electrical signal to the waveguides and/or the radio frequency RF front-end circuits. It being understood that the feeder tree supplies the radio front end components or antennas directly with the RF carrier, or the LO, or with the master clock signal. In the latter case, it is also important to keep the phase since the LO signal is the frequency reference to generate the RF carrier by the front end radio components (PLL, mixer, modulator, demodulator, PA, LNA . . . ), A signal is provided by the input/output circuit 340. The signal is distributed in the different branches of the tree structure and, more particularly follows the segments 320 and the arcs or arcuated segments which are part of the concentric circles 330. The circles are centered about the cylindrical shaped electromagnetic lens 200, as represented in FIG. 9*a*. Therefore the phase and the amplitude of the electrical signal are conserved. In case sixteen (16) waveguides are used in the implementation, then four (4) concentric circles level (having respectively radius: R1, R2, R3, and R4) are sufficient to route the radio frequency signal. The wave guides can be supplied directly without additional component by the input 340. To multiply the possible configurations, it can be useful to use integrated radio frequency electronic components directly on the feeder substrate 350. These electronic components can be radio frequency switches, Power Amplifiers, Low Noise Amplifiers, IF mixers-modulator or mixers-demodulator, etc. The front-end radio components such as power amplifiers, low noise amplifiers, or radio frequency switches can be introduced individually in the radius elements 320 and/or at various gaps in between concentric circles 330.

Figure 10A:
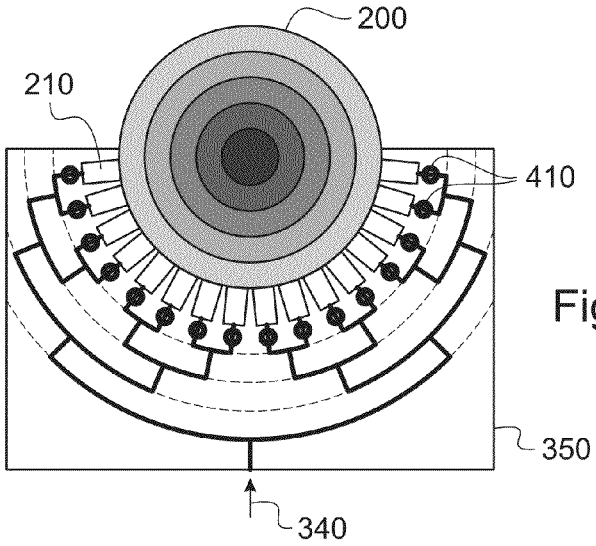
FIGS. 10*a-c* illustrate various possible positions for the electronic feeding circuits.
Figure 10B:
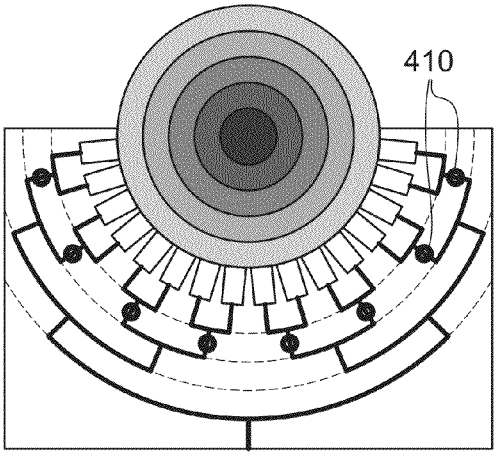
Figure 10C:
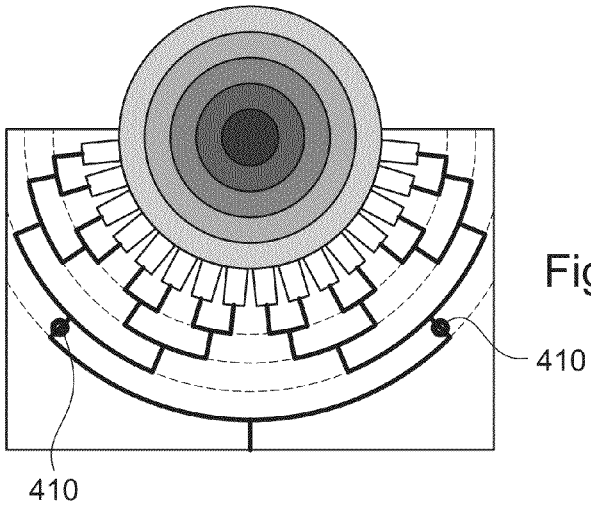

The FIG. 10*a-c* show various possible positions of the radio frequency components 410 of the implementation of the invention according to FIG. 9. In FIG. 10*a*, the radio frequency components are implemented on the radius between the wave guides 210 and the (C1) circle. This configuration allows activation of the sixteen (16) antenna transmission means separately. Further embodiments are represented in FIG. 10*b* and FIG. 10*c* where the electrical circuits are implemented on the radius between the circles C1 and C2 or between C3 and C4.

As illustrated in FIGS. 11*a-b*, in case only one waveguide is activated by an electrical (antenna transmission means 513; the other antenna transmission means 501-512 and 514-516 being inactive) signal then the antenna produces a narrow beam through the electromagnetic lens. Said narrow beam is characterized by a width of ten (10) degrees at three (3) dB in the azimuth plane. Similarly, three (3) antenna transmission means can be activated producing a multi-beam as illustrated in FIG. 12*a*, or sixteen (16) antenna transmission means can be activated producing a multi-beam as represented in FIG. 13*a*.

In FIG. 12*a*, three (3) antenna transmission means are active (501, 505, 515) and generate three (3) beams, namely the beam 601 by the antenna transmission means 501, the beam 605 by the antenna transmission means 505 and the beam 615 by the antenna transmission means 515. The other antenna transmission means 502-504, 506-514 and 516 are not activated. The result is represented in the graphs 630 of FIG. 12*b* in the azimuth plan, and in the graph 640 of FIG. 12*c* for a 3-dimensional representation.

In FIG. 13*a*, all the antenna transmission means are activated producing sixteen (16) beams. The result is a wide beam 731 of one hundred and sixty (160) degrees (16×10°) as illustrated by the graph 730 of FIG. 13*b*. Consequently, the invention offers the possibilities either to generate a number of single narrow beams and thus the possibility to concentrate the energy and save power, or to generate a wide beam. Said antenna can thus advantageously be applied in communication devices in order to reach other wireless devices during a discovery mode.

The preferred embodiment and variants of the invention described herein all have the additional advantage to operate both in emission mode and in reception mode. As illustrated by the FIG. 14*a*, the implementations are adapted to route the two signals on both modes. The high frequency (radio frequency) signal, or the master clock signal is routed from the input 340 on a layer 351 of FIG. 14*c* as described above, to maintain substantially equal the phase and the amplitude of the substrate 350. Said substrate can advantageously be composed of at least two (2) layers 351 and 352. Therefore, the low frequency such as the signal to command the radio front-end components, or the baseband signal (the In Phase and Quadrature signal for example) can be routed on a second layer 352 as shown in the FIG. 14*b* where for sake of clarity, only the latter layer is shown. Low frequency signals coming from the baseband circuit 860 can be routed in usual way. The electrical lines from 821 to 836, from 837 to 852 and from 853 to 868 are feeding the sixteen (16) electronic front-ends from 501 to 516. There is no need to have equal path length for these printed electrical lines. The electrical lines from 821 to 836, from 837 to 852 and from 853 to 868 are respectively dedicated to the DAC output signal in transmission mode, to the ADC input signal in reception mode and to the command signal comprising the ON-OFF switch of the radio frequency front-end components or of the antenna element switches.

The FIGS. 15, 16, 17 and 18 show the bloc diagrams of the baseband and radio electrical circuits. The blocs 900 and 901 form a classical radio circuit, are performing the frequency transposition between the baseband signal (low frequency) 903 and the radio signal (high frequency, here in the range of 60 GHz). The bloc 900 represents the Local Oscillator (LO) generating the high frequency signal to transpose this signal in the high frequency range. The base band signal travels through the bloc 901, representing a mixers-modulator or mixers-demodulator. The bloc 900 receives a clock reference signal 902 or for example a Master clock from the baseband circuit.

Here follows a symbolical and simplified representation of a classical radio circuit and the filters, Phase Locked Loop (PLL) components and the different stages needed for the frequency transposition are not represented. The embodiments described in the FIGS. 15, 16, 17 and 18 are given by way of example. This architecture is not restrictive.

Figure 15:
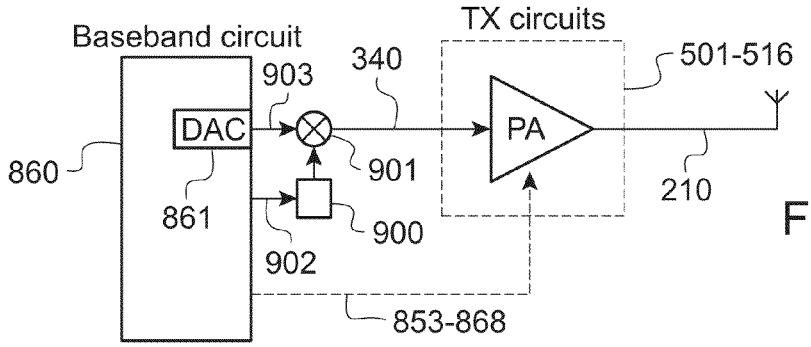
FIGS. 15, 16, 17 and 18 are schematic block diagrams of several parts of the circuit implementing the baseband and radio electrical circuits.

FIG. 15 contains a simplified representation of the circuit adapted to ensure the emission mode only. The DAC output signal 903 of the low frequency baseband signal is transposed by the mixer-modulator 901 in the range of the 60 Ghz and is connected to the input 340 of the feeder circuit in order to supply the radio frequency (RF) front-end circuit 501-516, here represented by a Power Amplifier. Said Power Amplifier can be switched ON or OFF by the command signal 853-868 that is routed on the second layer 352 of the substrate.

Figure 16:
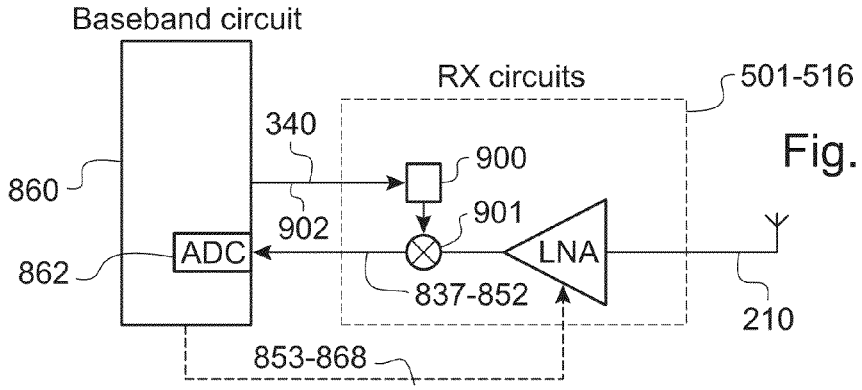
Figure 17:
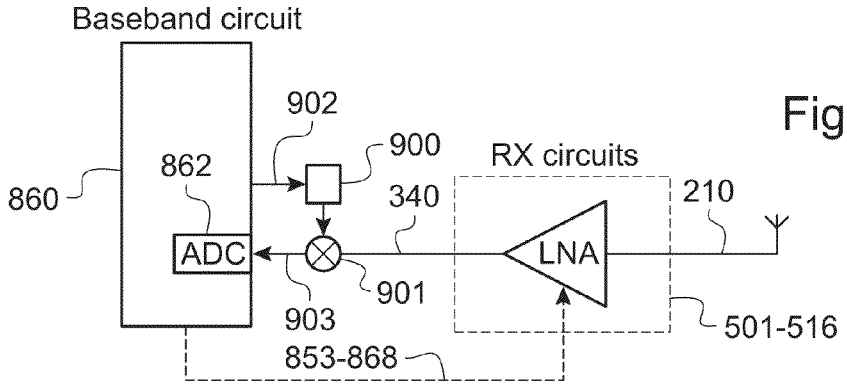

FIG. 16 represents the bloc diagram of the circuit adapted to operate in reception mode. The master clock 902 is routed through the input 340 on the first layer 351 of the substrate 350. The local oscillator or PLL-synthesizer 900 generates the high frequency signal to decrease the incoming signal frequency that is output by the Low Noise Amplifier (LNA). The low frequency signal coming from the demodulator circuitry 901 is connected to the baseband circuit by the second layer of the substrate through the lines 837-852. Consequently there is only one set of the synthesizer and demodulator circuit 900-901 per antenna transmission means. All the Low Noise Amplifier circuits 501-516 can be switched ON or OFF separately by the command lines 853-868. The latter configuration necessitates an important number of components. An alternative implementation is represented in FIG. 17 where the synthesizer and demodulator circuit 900-901 is close to the baseband part. In this configuration, only one set of the synthesizer and demodulator part 900-901 is needed and is shared by all the antenna transmission means. Therefore the output signal of the Low Noise Amplifier is routed via the first layer 351 of the substrate to the output 340. Consequently coherence between the phases at different reception angles is kept. Selectively, the Low Noise Amplifier circuits 501-516 can be switched ON or OFF individually by the command lines 853-868.

Figure 18:
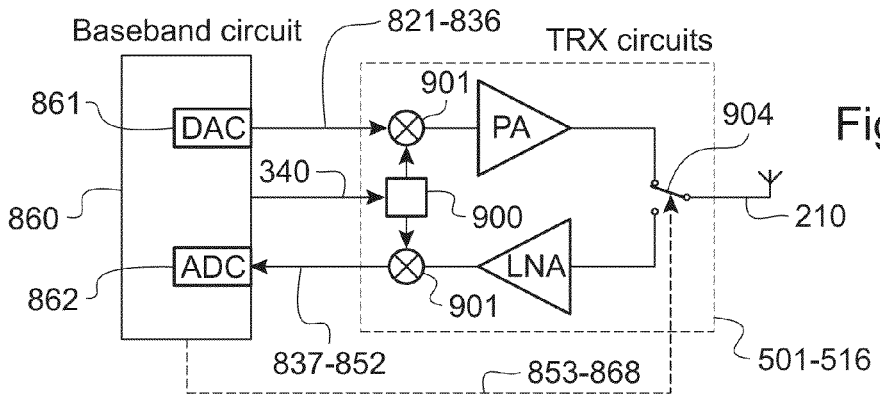

FIG. 18 illustrates the integration of the circuits for emission and reception modes on the same antenna system. The antenna system is in emission or reception mode by switching the switch 904 separately through the command lines 853-868.

The clock reference signal is routed through the 340 signal on the first layer 351 of the substrate to maintain the phase and amplitude of the signal.

The design of the antenna may advantageously incorporate MEMS (Microelectromechanical systems) switches to control the signals towards or from the radiating elements.

What is claimed is:

1. An antenna comprising:

an electromagnetic lens adapted to guide at least one electromagnetic signal by means of at least a variation in permittivity, wherein the electromagnetic lens comprises an inner part and an outer part, said inner part containing a plurality of holes and said outer part comprising at least a homogeneous layer, and at least one electromagnetically shielding member encapsulating the electromagnetic lens partially so as to direct at least one electromagnetic signal propagating through the electromagnetic lens.

2. The antenna according to claim 1, wherein the at least one electromagnetically shielding member guides at least one electromagnetic signal in a direction substantially parallel to the variation in permittivity of the electromagnetic lens.

3. The antenna according to claim 1, wherein the outer part is formed as a superposition of a plurality of homogeneous layers, each having a different permittivity.

4. The antenna according to claim 3, wherein each homogeneous layer of the outer part of the electromagnetic lens is made of a different foam material, each foam material having a specific permittivity.

5. The antenna according to claim 1, wherein the electromagnetic lens has a cylindrical shape.

6. The antenna according to claim 1, wherein said antenna comprises at least one antenna transmission means, adapted to radiate an electromagnetic signal into the electromagnetic lens and to receive an electromagnetic signal thereof.

7. The antenna according to claim 6, wherein the at least one antenna transmission means comprises at least one wave guide adapted to guide the electromagnetic signal to the electromagnetic lens and the electromagnetic signal received therefrom.

8. The antenna according to claim 7, wherein the at least one wave guide is part of the at least one electromagnetically shielding member.

9. The antenna according to claim 1, wherein the at least one electromagnetically shielding member is part of an enclosure, said enclosure encapsulating partially the electromagnetic lens.

10. The antenna according to claim 9, wherein the enclosure comprises an enclosure body and an enclosure boundary portion, said enclosure encapsulating partially the electromagnetic lens comprises the at least one electromagnetic shielding member.

11. The antenna according to claim 10, wherein the enclosure body comprises plastic material, and the at least one electromagnetically shielding member is a metalized part of the enclosure boundary portion.

12. The antenna according to claim 10, wherein the enclosure encapsulating partially the electromagnetic lens comprises metallic material and the at least one electromagnetically shielding member is the whole enclosure.

13. The antenna according to claim 12, comprising at least one antenna transmission means, adapted to radiate an electromagnetic signal into the electromagnetic lens and to receive an electromagnetic signal thereof, wherein the at least one antenna transmission means comprises at least one ridged wave guide, provided in the metallic enclosure encapsulating at least partially the electromagnetic lens.

14. The antenna according to claim 10, wherein the enclosure body comprises ceramic substrate and the at least one electromagnetically shielding member is a metallized member of the enclosure boundary portion.

15. The antenna according to claim 14, comprising at least one antenna transmission means, adapted to radiate an electromagnetic signal into the electromagnetic lens and to receive an electromagnetic signal thereof, wherein the at least one antenna transmission means comprises at least one wave guide integrated into the substrate by using SIW (Substrate Integrated Waveguide) techniques.

16. The antenna according to claim 9, wherein the antenna comprises locking means for locking said electromagnetic lens in the enclosure.

17. An antenna according to claim 16, wherein the locking means comprise at least one wiring means surrounding partially the electromagnetic lens and locking it in the enclosure.

18. An antenna according to claim 16, wherein the locking means comprise at least one pin and a corresponding recess for accommodating each pin and that are both adapted to lock the electromagnetic lens in the enclosure, said at least one pin and recess being respectively part of the electromagnetic lens and the enclosure or vice versa.

* * * * *